US009993935B2

(12) United States Patent
Lacroix

(10) Patent No.: US 9,993,935 B2
(45) Date of Patent: Jun. 12, 2018

(54) CROSSCLIPPING AND BUNDLING SYSTEM AND METHOD FOR VENEER PACKETS

(75) Inventor: Wolfgang Lacroix, Lichtenstein-Unterhausen (DE)

(73) Assignee: DANZER SERVICES SCHWEIZ AG, Baar (CH)

( * ) Notice: Subject to any disclaimer, the term of this patent is extended or adjusted under 35 U.S.C. 154(b) by 678 days.

(21) Appl. No.: 12/866,179

(22) PCT Filed: Mar. 9, 2009

(86) PCT No.: PCT/EP2009/001683

§ 371 (c)(1), (2), (4) Date: Aug. 4, 2010

(87) PCT Pub. No.: WO2009/112229

PCT Pub. Date: Sep. 17, 2009

(65) Prior Publication Data

US 2011/0011497 A1 Jan. 20, 2011

Related U.S. Application Data

(60) Provisional application No. 61/035,591, filed on Mar. 11, 2008.

(51) Int. Cl.
*B27H 1/00* (2006.01)
*B27M 1/00* (2006.01)
(Continued)

(52) U.S. Cl.
CPC . *B27B 5/04* (2013.01); *B27L 5/08* (2013.01)

(58) Field of Classification Search
CPC .. B42C 9/00; B42C 7/00; B42C 11/00; B42C 13/00; B42C 11/02; B42C 5/00; B42B 9/00; B27B 5/04; B27L 5/08
(Continued)

(56) References Cited

U.S. PATENT DOCUMENTS 2,262,796 A * 11/1941 Cavalero ..... 281/29
2,394,324 A * 2/1946 Miller ..... B27L 5/08 83/297
(Continued)

FOREIGN PATENT DOCUMENTS

CA 2373143 A1 * 9/2001
DE 296 13 289 U1 1/1997
(Continued)

OTHER PUBLICATIONS

International Preliminary Report on Patentability for PCT International Application No. PCT/EP2009/001683 dated Sep. 14, 2010.
(Continued)

*Primary Examiner* — Justin V Lewis
(74) *Attorney, Agent, or Firm* — Barnes & Thornburg LLP

(57) ABSTRACT

An apparatus for clipping ends of a book of sheets includes a first detector for detecting a first end of the book of sheets, a clipper positioning system and a first clipper including a knife. The clipper positioning system is adapted to automatically position the first clipper to a proposed first clipping position based on the detected first end of the book of sheets. A method of processing a plurality of sheets includes assembling the plurality of sheets into a book of sheets, detecting a first end of the book of sheets to propose a first position for clipping the book of sheets, positioning a first clipper based on the detected first end of the book of sheets, advancing the book of sheets to an infeed conveyor, detecting, the presence of the book of sheets in the infeed conveyor, advancing the book of sheets to the first clipper, clipping the first end of the book of sheets, and advancing the book of sheets from the first clipper.

15 Claims, 10 Drawing Sheets

(51) Int. Cl.

| | |
|---|---|
| ***B27L 5/02*** | (2006.01) |
| ***B27M 1/02*** | (2006.01) |
| ***B27L 5/04*** | (2006.01) |
| ***B26D 5/00*** | (2006.01) |
| ***B26D 5/38*** | (2006.01) |
| ***B27B 5/04*** | (2006.01) |
| ***B27L 5/08*** | (2006.01) |

(58) Field of Classification Search
USPC .... 412/1, 3, 4, 9, 11, 14, 16, 17, 19, 25, 32, 412/33; 83/368, 370–372; 144/209.1, 144/210, 211, 212, 332, 359, 362, 363
See application file for complete search history.

(56) References Cited

U.S. PATENT DOCUMENTS

| | | | | | |
|---|---|---|---|---|---|
| 2,615,484 | A * | 10/1952 | Roberge | B27L 9/00 | 144/369 |
| 3,477,327 | A * | 11/1969 | Aizawa | B23D 36/00 | 83/289 |
| 4,324,013 | A * | 4/1982 | Wu | 412/33 | |
| 4,507,037 | A * | 3/1985 | Fenimore | 412/11 | |
| 4,606,387 | A * | 8/1986 | Weislogel | B26D 7/0675 | 144/2.1 |
| 4,681,002 | A * | 7/1987 | Nakaya | B26D 7/1836 | 83/76.1 |
| 4,700,758 | A * | 10/1987 | Bernath | B23D 59/008 | 144/118 |
| 5,201,258 | A | 4/1993 | Cremona | | |
| 6,263,773 | B1 * | 7/2001 | McAdoo | B23D 59/001 | 144/357 |
| 2005/0120840 | A1 * | 6/2005 | Koskovich | B23D 59/001 | 83/13 |
| 2007/0212199 | A1 * | 9/2007 | Sasamoto | 412/9 | |
| 2008/0199276 | A1 * | 8/2008 | Graushar et al. | 412/4 | |
| 2009/0116935 | A1 * | 5/2009 | Porat | 412/3 | |

FOREIGN PATENT DOCUMENTS

| | | | |
|---|---|---|---|
| EP | 500161 | A2 * | 8/1992 |
| EP | 0500181 | | 8/1992 |
| GB | 208618 | A * | 12/1923 |
| GB | 1085234 | A * | 9/1967 |
| WO | WO 2007068075 | A1 * | 6/2007 |
| WO | 20070149131 | | 12/2007 |

OTHER PUBLICATIONS

International Search Report/Written Opinion for PCT/EP2009/001683 dated Jun. 4, 2009.
Official action for related EP 09 718 675.3-2302 dated Apr. 4, 2012, 4 pages.
European office action from related EP 09 718 675.3-1702 dated Feb. 21, 2013, 4 pages.

* cited by examiner

CROSSCLIPPING AND BUNDLING SYSTEM AND METHOD FOR VENEER PACKETS

CROSS REFERENCE TO RELATED APPLICATIONS

This application is the U.S. national phase of PCT/EP2009/001683 filed Mar. 9, 2009. PCT/EP2009/001683 claims the benefit under 35 U. S. C. § 119(e) of U.S. Ser. No. 61/035,591 filed Mar. 11, 2008. The complete disclosures of U.S. Ser. No. 61/035,591 and PCT/EP2009/001683 are hereby incorporated herein by reference.

FIELD OF THE INVENTION

This invention relates to the processing of wood veneer. It is disclosed in the context of a clipper for clipping the ends of bundles or packets (hereinafter sometimes referred to as books) of veneer.

BACKGROUND OF THE INVENTION

In the past, sheets of wood veneer have been trimmed using guillotine-type clippers. In such veneer trimmers, stacked sheets, or books, of wood veneer are trimmed. In addition, the books may be split, for example, by parallel connected circular saws positioned in a row transverse to the direction of the cuts.

DISCLOSURE OF THE INVENTION

According to a first aspect of the invention, an apparatus for clipping ends of a book of sheets comprises a first detector for detecting a first end of the book of sheets, a clipper positioning system and a first clipper including a knife. The clipper positioning system is adapted to automatically position the first clipper to a proposed first clipping position based on the detected first end of the book of sheets.

Illustratively, the first clipper is adapted to be manually movable from the proposed first clipping position.

Illustratively, the clipper positioning system comprises a stageless positioning system.

Illustratively, the clipper positioning system includes a servo-controlled motor.

Illustratively, the first clipper further comprises a first bundler adapted to bundle the book of sheets.

Illustratively, the first clipper is adapted to clip and bundle the book of sheets.

Further illustratively, the apparatus comprises a first infeed conveyor including a first sensor for detecting the presence of a book of sheets positioned in the first infeed conveyor.

Illustratively, the first infeed conveyor is adapted to transfer the book of sheets to the clipper positioning system after the first sensor detects the presence of the book of sheets.

Illustratively, the first clipper includes a second sensor for detecting that the book of sheets is properly positioned in the first clipper.

Further illustratively, the apparatus comprises a first emitter for projecting an index of the proposed clipping position on the book of sheets.

Illustratively, the first emitter comprises a line laser for projecting a laser line onto the book of sheets to indicate the proposed clipping location.

Further illustratively, the apparatus comprises an outfeed conveyor.

Further illustratively, the apparatus comprises an automatic length measuring system. The outfeed conveyor is adapted to transfer a bundled book of sheets to the automatic length measuring system.

Further illustratively, the apparatus comprises a second detector for detecting a second end of the book of sheets and a second clipper including a knife. The clipper positioning system is adapted to automatically position the second clipper to a proposed second clipping position based on the detected second end of the book of sheets.

Further illustratively, the apparatus comprises a second bundler operable to automatically bundle the book of sheets.

Illustratively, the first bundler and second bundler cooperate to automatically bundle the book of sheets.

Further illustratively, the apparatus comprises a second infeed conveyor including a third sensor for detecting the presence of a book of sheets positioned in the second infeed conveyor.

Illustratively, the first and second infeed conveyors are adapted to transfer the book of sheets to the clipper positioning system after the first and third sensors detect the presence of the book of sheets.

Further illustratively, the apparatus comprises a third infeed conveyor.

Illustratively, the first, second and third infeed conveyors are adapted to transfer the book of sheets to the clipper positioning system after the first and third sensors detect the presence of the book of sheets.

Illustratively, an infeed conveyor is operable to convey a book of sheets to an outfeed conveyor after the book of sheets has been bundled.

According to another aspect of the invention, a method of processing a plurality of sheets comprises forming the plurality of sheets into a book of sheets, detecting a first end of the book of sheets to propose a first position for clipping the book of sheets, positioning a first clipper based on the detected first end of the book of sheets, advancing the book of sheets to an infeed conveyor, detecting the presence of the book of sheets in the infeed conveyor, advancing the book of sheets to the first clipper, clipping the first end of the book of sheets, and advancing the book of sheets from the first clipper.

Further illustratively, the method comprises projecting an index onto the book of sheets which is indicative of the first position for clipping.

Further illustratively, the method comprises bundling the book of sheets in a bundle prior to advancing the book of sheets from the clipper.

Further illustratively, the method comprises automatically measuring the length of the book of sheets after the book of sheets has been clipped and bundled.

Further illustratively, the method comprises bundling the book of sheets and measuring the length of the bundled book of sheets.

Further illustratively, the method comprises detecting a second end of the book of sheets to propose a second position for clipping the book of sheets.

Further illustratively, the method comprises automatically positioning a second clipper based on the detected second end of the book of sheets.

Further illustratively, the method comprises automatically advancing the book of sheets to the second clipper.

Further illustratively, the method comprises clipping the second end of the book of sheets.

Further illustratively, the method comprises bundling the book of sheets adjacent a first end of the book of sheets and adjacent a second end of the book of sheets.

Further illustratively, the method comprises measuring the length of the book of sheets after the book of sheets has been clipped and bundled.

BRIEF DESCRIPTIONS OF THE DRAWINGS

The invention may best be understood by referring to the following detailed descriptions and accompanying drawings which illustrate the invention. In the drawings.

DETAILED DESCRIPTIONS OF ILLUSTRATIVE EMBODIMENTS

Figure 1:
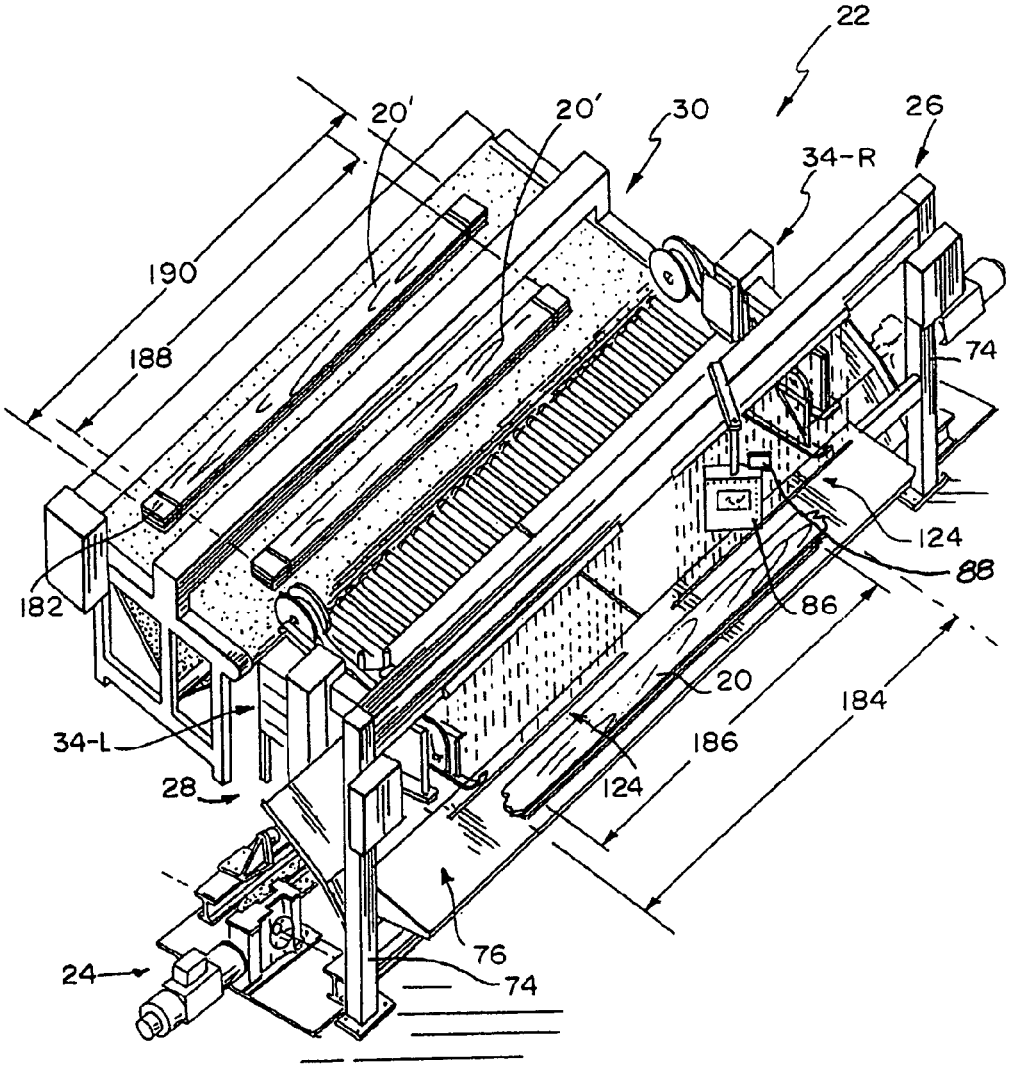
FIG. 1 illustrates an overhead perspective view of a system constructed according to the invention.

A book 20 of stacked sheets of veneer is positioned in a cross-clipping system 22 as illustrated in FIG. 1. The illustrated book 20 of veneer may have been previously trimmed lengthwise, for example, as described in published U.S. patent application 2007-0289673-A1, published Dec. 20, 2007, the disclosure of which is hereby incorporated herein by reference. Illustratively after such lengthwise trimming, the book 20 is transferred to the cross-clipping system 22 for further processing and data collection. The cross-clipping system 22 includes a portal 26, a clipper positioning system 24, an outfeed conveyor 28, and a surface area measuring system 30. Once positioned on the portal 26, the ends of the book 20 are trimmed by a pair of clippers 34-L and 34-R to reduce its length from a length 184 to a length 186. Clippers 34-L and 34-R are automatically positioned by the positioning system 24. The clippers 34-L and 34-R trim the book 20, which is then automatically bundled to form a bundled book 20'. The bundled book 20' is then fed via the outfeed conveyor 28 from the portal 26 to the measuring system 30 where the books 20' are automatically measured for length 186. The length 186 represents a yielded length determined by the cross-clipping system 22 to yield a preferred length for the book 20'.

Figure 2:
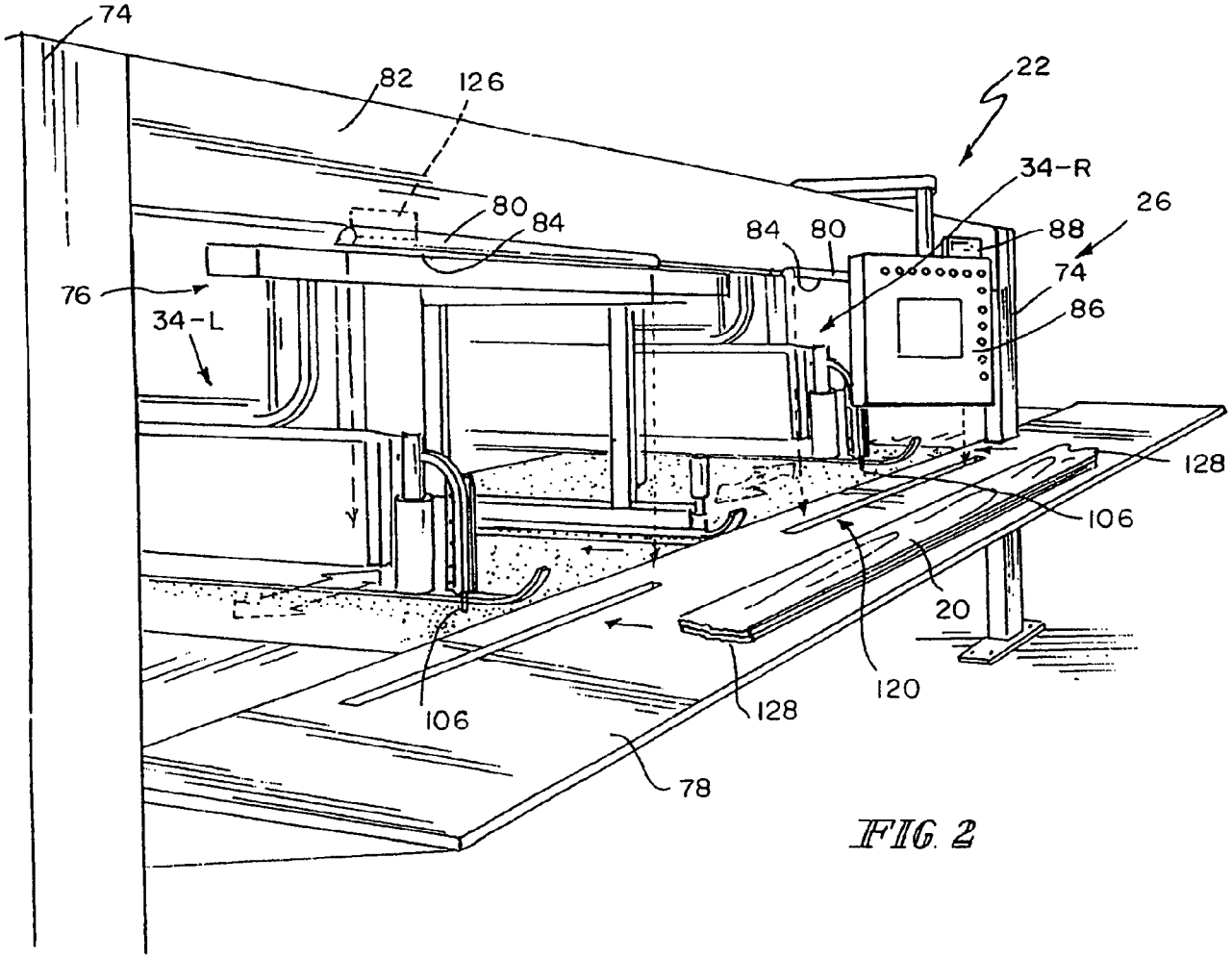
FIG. 2 is a perspective view of a detail of the system illustrated in FIG. 1.
Figures 3, 3A:
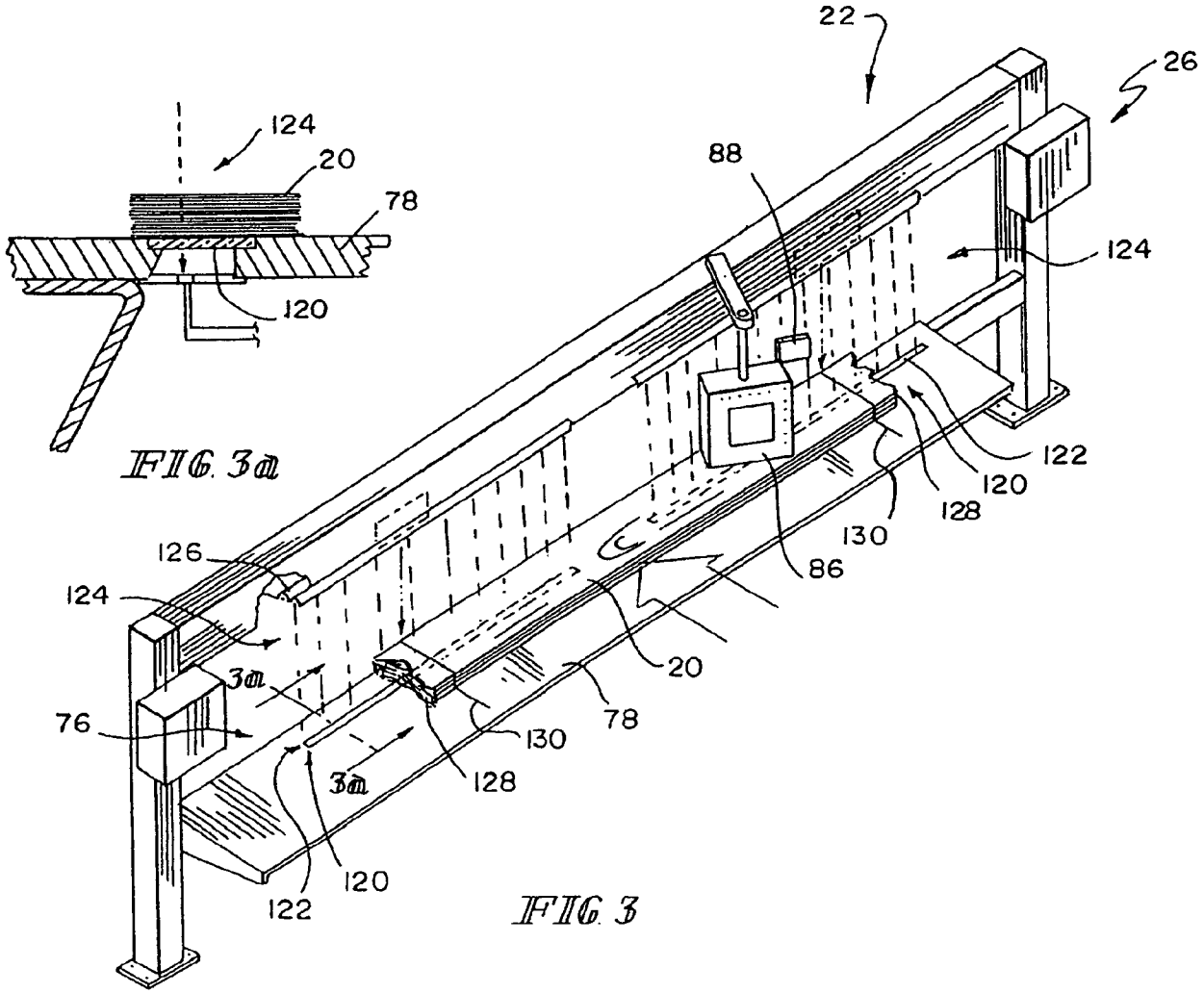
FIG. 3 illustrates a partly broken away overhead perspective view of a detail of the system illustrated in FIG. 1.
FIG. 3A illustrates a much enlarged sectional end view of a detail of FIG. 3.

Referring now to FIGS. 2-3, the portal 26 includes an infeed table 78, integrated length-measuring system 76 for measuring the length of a book 20, and two linear axles 80, 80 on which line lasers 84, 84 are mounted. The portal 26 includes structural steel profiles 74. An operating console 86 and a barcode scanner 88 are also provided for book 20' data collection.

Figure 4:
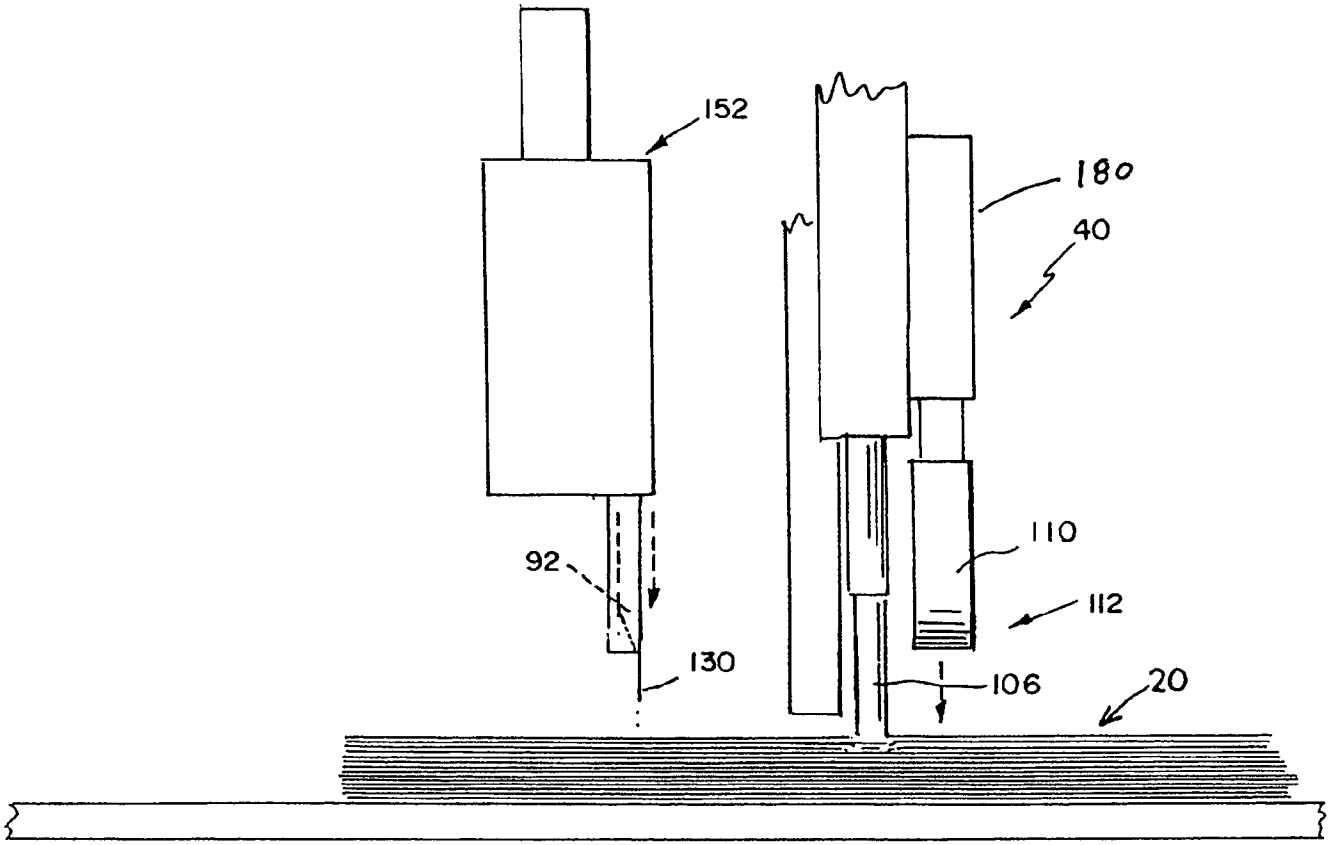
FIG. 4 illustrates a partly broken away plan view of a detail of the system illustrated in FIG. 1.

The book 20 of veneer is positioned on the infeed table 78 for pre-clipping processing. The book 20 is positioned such that it is approximately centered on the feeding table 78 such that a portion of the book overlies (an) aperture(s) 120 provided in the table. The length-measuring system 76 includes a pair of measuring lightcurtains 124, 124, illustratively KONTURflex K10-2240 measuring lightcurtains available from Leuze lumiflex GmbH+Co. of Füstenfeldbruck, Germany. The aperture 120 includes a receiver 122 of length-measuring system 76. The length-measuring system 76 uses a light emitter 126 which emits a light signal which is detected by the receiver 122 to determine the position of an end 128 of the book 20 of veneer. The clippers 34-L and 34-R are positioned based on the signal from the length-measuring system 76 with a cutting position indicated by a line laser 130 index provided by the line lasers 84, 84 positioned on the portal 26 as illustrated in FIG. 4. If an operator determines that the position of either clipper 34-L, 34-R is incorrect, for example, due to flaws in the material or for any other reason, the position of the clipper 34-L, 34-R is changed manually using a hand-wheel coupled with the clipper 34-L, 34-R to reposition the clipper 34-L, 34-R to the appropriate clipping location.

Figure 7:
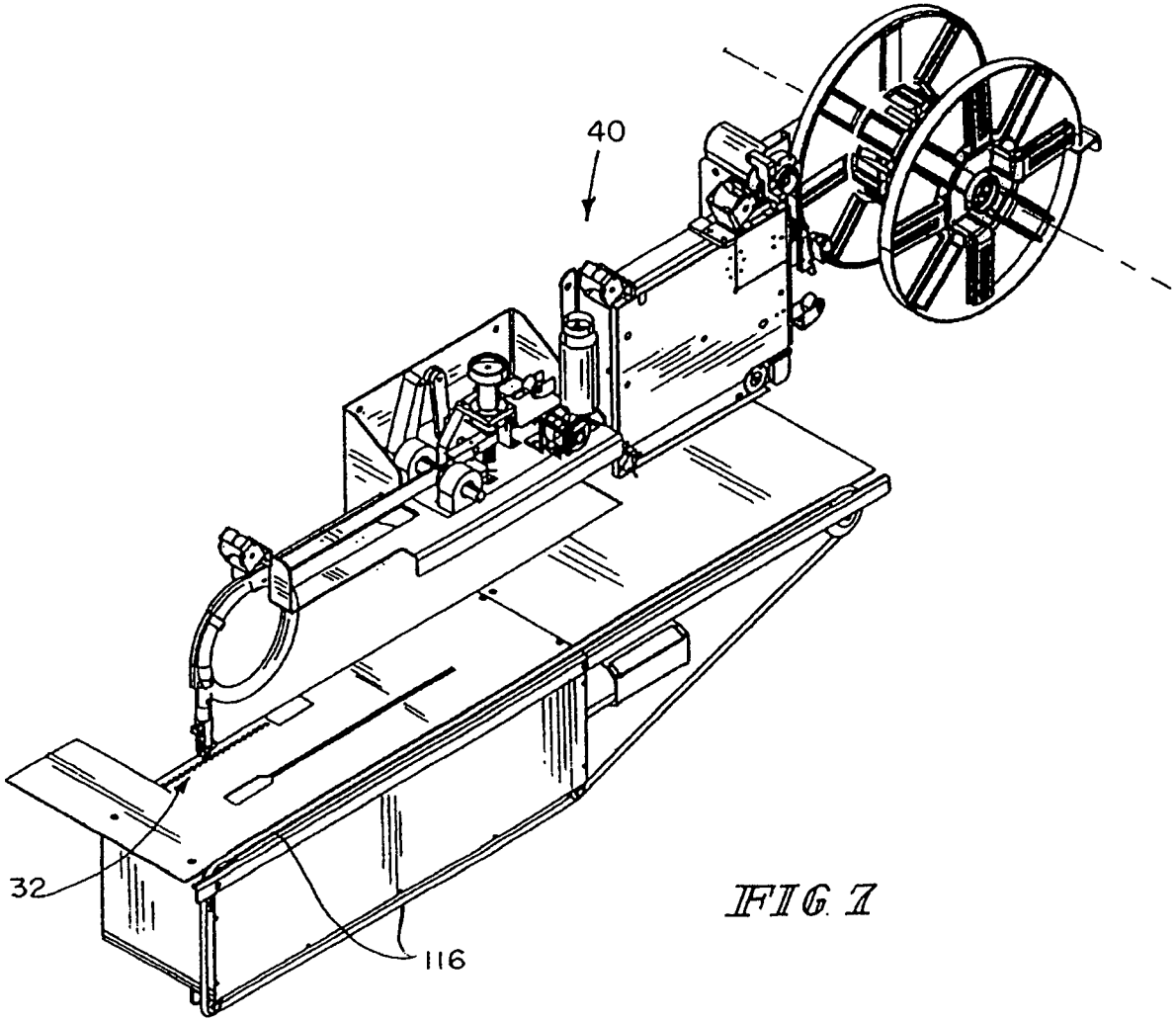
FIG. 7 illustrates an overhead perspective view of a portion of the detail illustrated in FIG. 6.

Once the clipping locations are properly set, the book 20 is advanced from the feeding table 78 to the clipper positioning system 24. Upon contact with the positioning pins 106, 106 of each of the clippers 34-L and 34-R, the book 20 activates a respective light bar 108 on the respective clipper 34-L or 34-R. The light bar 108 illustratively is a part number 0J5054 laser diffuse reflection sensor available from IFM Electronic GmbH. Both of the clippers 34-L, 34-R as well as a middle station 66 include a respective controlled intake 112 which acts as a respective infeed conveyor. Each of the controlled intakes 112 include a press rail 110. The press rail 110 of middle station 66 is best illustrated in FIG. 2. Upon activation of the light bars 108, 108, the press-shoe rails 110, 110, 110 are lowered to press the book 20 against respective belts 116, 116, 116 of the controlled intakes 112, 112, 112. The belts 116, 116, 116 are actuated to transport the book 20 into position to be cut and bundled. A light sensor 32, illustrated in FIG. 7, on each of the clippers 34-L, 34-R recognizes that the book 20 is properly positioned to be cut and bundled. The light sensors 32 illustratively are KONTURflex K5-240 measuring lightcurtains from Leuze lumiflex GmbH+Co. If necessary, the position of the book 20 is automatically adjusted by the controlled intakes 112, 112, 112. Once the book 20 is properly positioned, the book 20 is clipped and bundled automatically.

Figure 5:
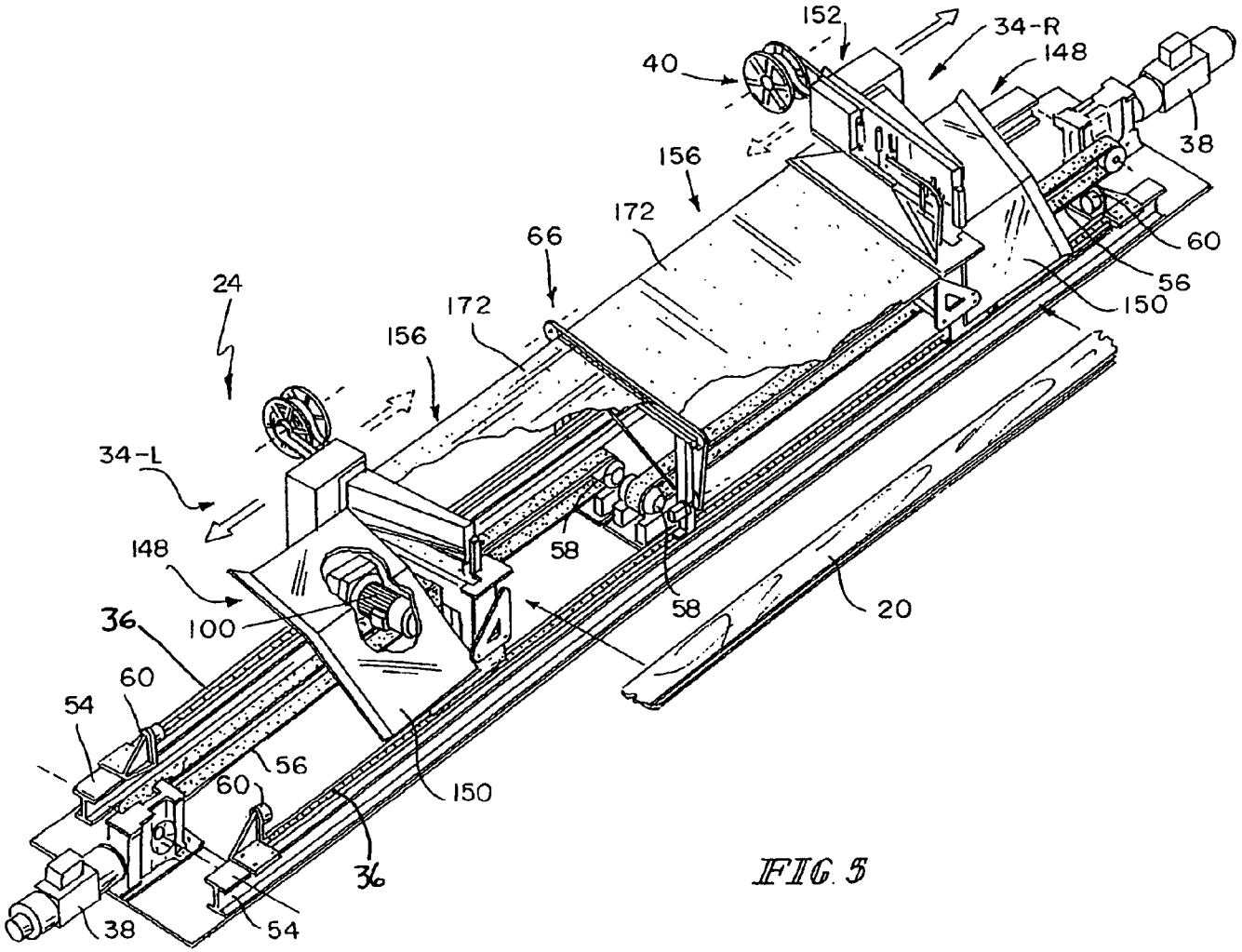
FIG. 5 is a partly broken away perspective view of a detail of the system illustrated in FIG. 1.
Figure 6:
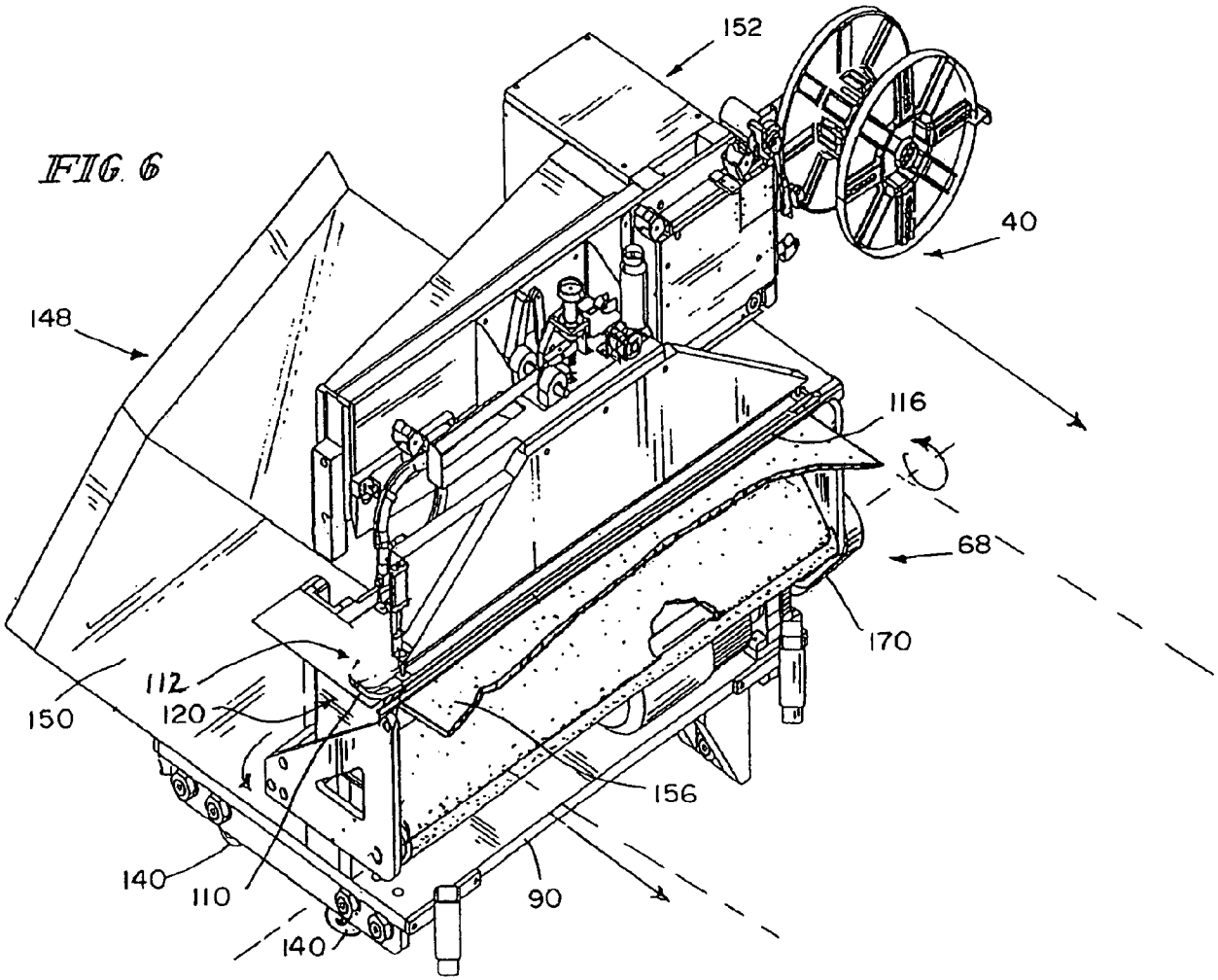
FIG. 6 illustrates an overhead perspective view of a detail of the system illustrated in FIG. 1.

Referring again to FIG. 1, the cross-clipping system 22 includes a positioning system 24 for positioning the clippers 34-L and 34-R. Referring to FIG. 5, the positioning system 24 includes intercritical dual phase—(hereinafter sometimes IDP)—steel girders 54 on which are mounted hardened guide rails 36. The positioning system 24 also includes servo-drive motors 38, 38 driving respective toothed belts 56, 56. The clipper 34-L and 34-R are each supported on a plurality of rollers 140 (FIG. 6). The servo-drive motors 38, 38 drive the toothed belts 56, 56 to position the clipper 34-L and 34-R which move on the guide rails 36, 36 of the positioning system 24. The servo-drive motors 38, 38 provide stageless operation of the clipper 34-L and 34-R. This permits the clippers 34-L and 34-R to be independently positioned in any position along the guide rails 36, 36.

In the middle of the positioning system 24 are gear belt pulleys 58, 58 which provide controlled movement of the toothed belts 56, 56. Stops 60, 60 positioned at each end of the guide rails 36, 36 prevent the clippers 34-L and 34-R from inadvertently coming off from the guide rails 36, 36. Movement of the clippers 34-L and 34-R is controlled by a system controller housed in the console 86 of the cross-clipping system 22.

Each clipper 34-L, 34-R includes a positioning plate 90 (FIGS. 6 and 8) supported on the rollers 140. A waste slide 148 receives waste cut from the book 20 and gravity feeds the waste down a chute 150 away from the positioning system 24. Each clipper 34-L, 34-R also includes a knife assembly 152, a bundling mechanism 40, an automatic intake 112, and a belt reel 68. A separate belt 156 (FIG. 5) is coupled to the powered middle station 66 and to belt reel 68 of each of the clipper 34-L, 34-R and extends between the powered middle station 66 and the respective clipper 34-L, 34-R to provide support for the book 20 during the clipping and bundling process. Referring to FIG. 9, the belt 156 is fed over a deflection roller 160 as indicated by arrow 162 and fed over an idler roller 164. The belt 156 is clamped to a clamp roller 166. The clamp roller 166 is driven by a motor 168 which drives a chain drive 170 which rotates the clamp roller 166 to gather or release the belt 156. The belt 156 is gathered when the clipper 34-L, 34-R moves toward the middle station 66 and is released when the clipper 34-L, 34-R moves away from the middle station 66. Thus, the belt 56 provides a support surface 172 for supporting the book 20 during the clipping and bundling process. The motor 168 is controlled to move synchronously with the respective servo-drive motor 38 of the positioning system 24 to maintain the proper length of the belt 156 based on the position of the clipper 34. The setup of the positioning configuration is such that, in order to adjust and align the machine for positioning, the operator needs to move the book 20 on top of the measuring device 76 slightly to the left or right so that the machine centers edge-to-edge.

Figure 8:
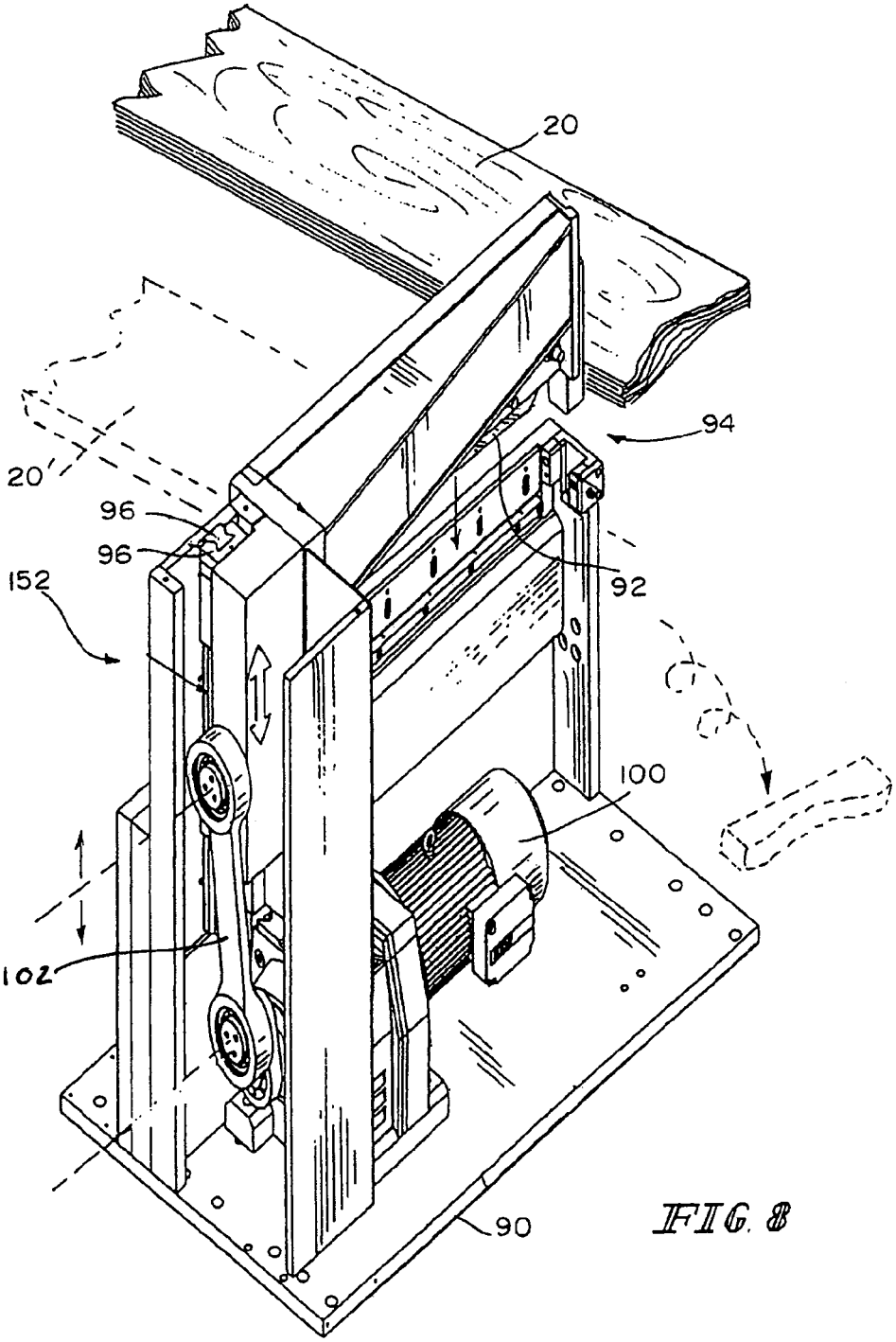
FIG. 8 illustrates an overhead perspective view of a portion of the detail illustrated in FIG. 6.
Figure 9:
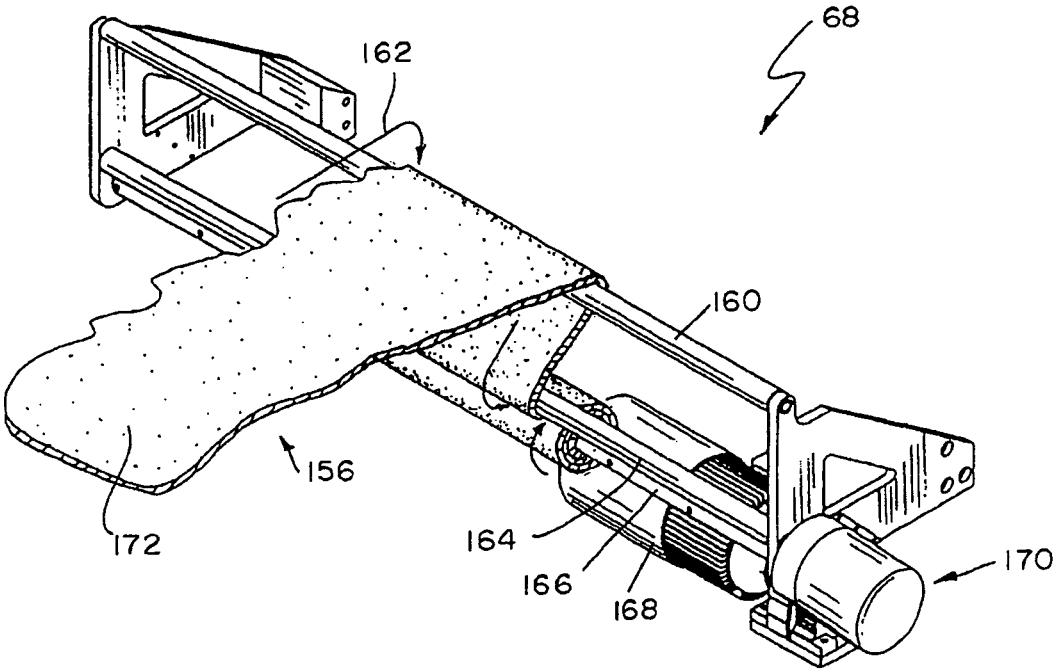
FIG. 9 illustrates an overhead perspective view of a portion of the detail illustrated in FIG. 6.

The knife assembly 152 is attached to the positioning plate 90 as illustrated in FIG. 8. The clipper 34-L, 34-R structure is welded steel construction. The knife assembly 152 includes a heavy duty positioner 94, two linear bearings and positioning rail 96. This provides an open arrangement which permits clipping in throughput. The adjustable centering of the knife bar 92 provided by positioner 94 promotes optimal cutting of the books 20. The knife bar 92 is driven by a drive motor 100 through a crank drive 102 coupled between them.

A suitable bundle mechanism 40 is available from, for example, EAM-Mosca Corporation, Valmont Industrial Park, 675 Jaycee Drive, W. Hazleton, Pa. 18202.

With the illustrated cross-clipping system 22, one operator can clip and bundle books 20 in throughput. This is achieved by combining the knife assembly 152 with the bundling mechanism 40, the built-in length-measuring system 76, and the integration of the belt reel 68.

Figure 10:
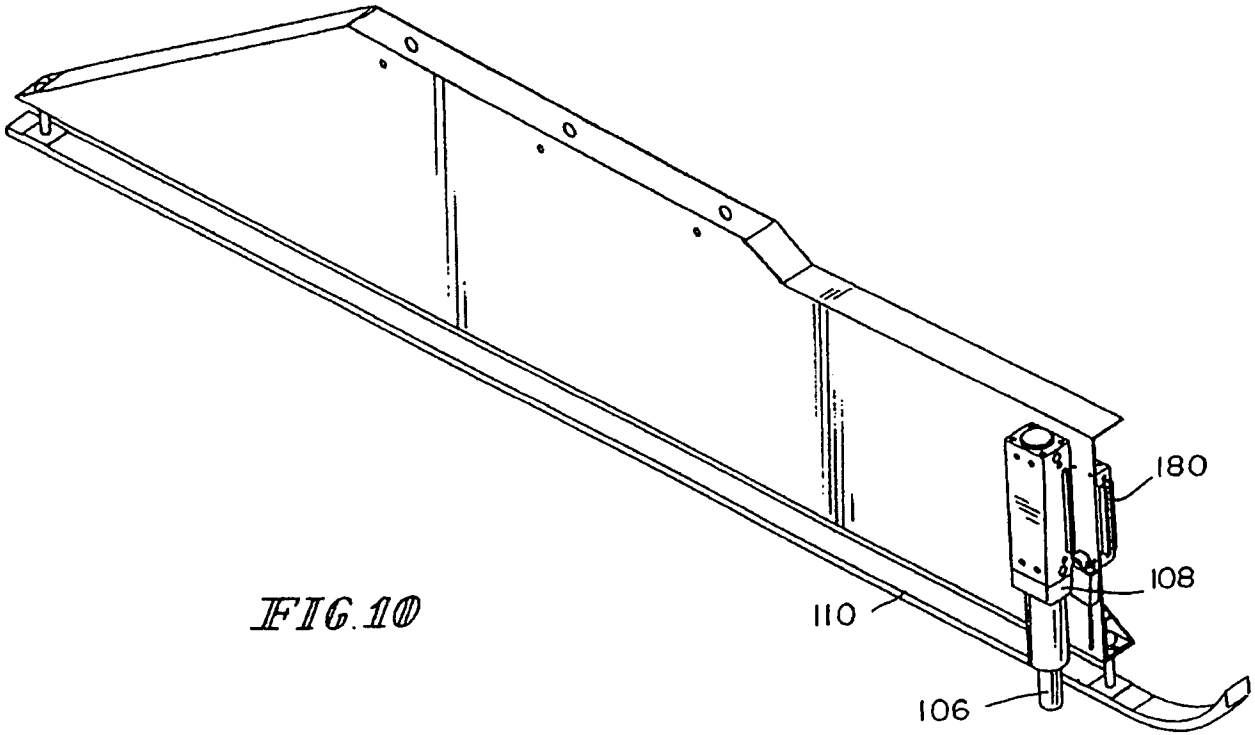
FIG. 10 illustrates an overhead perspective view of a detail of the system illustrated in FIG. 1.

The operating sequence for the cross-clipping system 22 is as follows. The operator positions a book 20 by centering it at the middle of the intake table 78 (FIG. 3). The length-measuring system 76 (FIG. 3) which is located on the intake table 78 automatically measures the length of the book 20 and both clippers 34-L, 34-R are set to this length. The cutting position is shown with the line laser, which automatically moves to the measured or input position. The book 20 can then be clipped. If corrections need to be made, for example, due to defects or cracks in the veneer which makes up the book 20, the operator makes the necessary adjustments with the help of two hand-wheels that are coupled with the line lasers 84, the amounts to be cut by the left and right clippers 34-L and 34-R respectively, are set, and the book 20 is released for intake. The release is a function of the book 20 landing against the positioning pins 106 (FIG. 10). Landing against the positioning pins 106 causes the light bar 108 to be activated. The press-shoe rails 110 (FIG. 10) are lowered by pneumatic actuators 180, causing the book 20 to be pressed against the controlled intakes 112, 112, 112 (FIG. 4) with belts 116, 116, 116 which are located on the clippers 34-L and 34-R and at the middle station 66 (FIG. 2). The book 20 is thus transported into the cut-bundle position with the belts 116.

The clipper 34-L and 34-R measuring systems 32 recognize when the book 20 is in position for clipping. If necessary, the position is automatically corrected. When the correct position is reached by the book 20 at each clipper 34-L, 34-R, then the clipper 34-L, 34-R knife assembly 152 and bundler 40 are both enabled to bundle and clip the book 20. This entire process runs automatically, so that while this process is running, the operator can position the next book 20 into the intake position.

After the books 20' are bundled and clipped, the books 20' are transported to the outfeed 28. From there the books 20' are directly pushed onto the measuring system 30. The measuring system 30 is configured to measure the dimensions of the book 20' and to record data regarding the size of the book in a data management system so that the book 20' may be properly inventoried. For example, one book 20' shown in FIG. 1 has a trimmed length 188 while a second book 20' has a length 190. The various lengths of the books 20', 20' will be associated with unique barcode identifiers so that the dimensions of the books 20', 20' may be ascertained from the identifiers in inventory.

What is claimed is:

1. An apparatus for clipping ends of a book of sheets of wood veneer, the apparatus comprising a first detector for detecting a position of a first end of the book of sheets of wood veneer, a second detector for detecting a position of a second end of the book of sheets of wood veneer, a clipper positioning system, a first clipper including a first knife, a second clipper including a second knife, a first bundler operable to automatically bundle the book of sheets of wood veneer adjacent the first end of the book of sheets of wood veneer, and a second bundler operable to automatically bundle the book of sheets of wood veneer adjacent the second end of the book of sheets of wood veneer, wherein the clipper positioning system is adapted to automatically position the first clipper at a proposed first clipping position relative to the book of sheets of wood veneer based on the position of the first end of the book of sheets of wood veneer and to automatically position the second clipper to a proposed second clipping position relative to the book of sheets of wood veneer based on the position of the second end of the book of sheets of wood veneer, wherein the first clipper further comprises the first bundler to permit the first clipper to bundle and clip the book of sheets of wood veneer, the first bundler being a reel-type bundling mechanism, and wherein the second clipper further comprises the second bundler to permit the second clipper to bundle and clip the book of sheets of wood veneer, the second bundler being a reel-type bundling mechanism.

2. The apparatus of claim 1 wherein the first clipper is adapted to be manually movable from the proposed first clipping position.

3. The apparatus of claim 1 wherein the clipper positioning system comprises a stageless positioning system.

4. The apparatus of claim 1 wherein the clipper positioning system includes a servo-controlled motor.

5. The apparatus of claim 1 further comprising a first infeed conveyor including a first sensor for detecting a book of sheets of wood veneer positioned in the first infeed conveyor.

6. The apparatus of claim 5 wherein the first infeed conveyor is adapted to transfer the book of sheets of wood veneer to the clipper positioning system after the first sensor detects the book of sheets of wood veneer.

7. The apparatus of claim 6 wherein the first clipper includes a second sensor for detecting that the book of sheets of wood veneer is properly positioned for cutting in the apparatus.

8. The apparatus of claim 1 further comprising an outfeed conveyor.

9. The apparatus of claim 8 further comprising an automatic length measuring system, the outfeed conveyor being adapted to transfer a bundled book of sheets of wood veneer to the automatic length measuring system.

10. The apparatus of claim 7 further comprising a second infeed conveyor including a third sensor for detecting a book of sheets of wood veneer positioned in the second infeed conveyor.

11. The apparatus of claim 10 wherein the first and second infeed conveyors are adapted to transfer the book of sheets of wood veneer to the clipper positioning system after the first and third sensors detect the book of sheets of wood veneer.

12. The apparatus of claim 10 further comprising a third infeed conveyor.

13. The apparatus of claim 12 wherein the first, second, and third infeed conveyors are adapted to transfer the book of sheets of wood veneer to the clipper positioning system after the first and third sensors detect the book of sheets of wood veneer.

14. The apparatus of claim 1 wherein an infeed conveyor is operable to convey a book of sheets of wood veneer to an outfeed conveyor after the book of sheets of wood veneer has been bundled.

15. The apparatus of claim 1 wherein the proposed first clipping position is one of a plurality of clipping positions, and at each of the plurality of clipping positions, the first clipper is movable between (i) a disengaged position in which the knife is spaced apart from the book of sheets of wood veneer, and (ii) an engaged position in which the knife is engaged with the book of sheets of wood veneer.

* * * * *